United States Patent [19]

Stöffler

[11] Patent Number: 4,610,283

[45] Date of Patent: Sep. 9, 1986

[54] CHECKING AND FILLING DEVICE FOR POWDER EXTINGUISHERS

[75] Inventor: Bernhard Stöffler, Gärtringen, Fed. Rep. of Germany

[73] Assignee: Vulkan-Werk Wilhelm Diebold, Fed. Rep. of Germany

[21] Appl. No.: 596,035

[22] Filed: Apr. 2, 1984

[30] Foreign Application Priority Data

May 2, 1983 [DE] Fed. Rep. of Germany ..... 3315893

[51] Int. Cl.[4] ..... B65B 1/16; B65B 3/28

[52] U.S. Cl. ..... 141/89; 406/172; 141/67; 141/286; 141/367; 55/302

[58] Field of Search ..... 141/89, 67, 94, 83, 141/18, 37, 49, 45, 65, 1, 285, 286, 311, 348, 325, 326, 367, 368, 369, 372, 375–378, 383, 384; 406/172, 171; 55/302

[56] References Cited

U.S. PATENT DOCUMENTS

| | | | |
|---|---|---|---|
| 2,628,965 | 2/1953 | Sullivan, Jr. | 55/302 X |
| 3,112,776 | 12/1963 | Riley | 141/67 |
| 3,421,295 | 1/1969 | Swift et al. | 55/302 |
| 3,875,980 | 4/1975 | Getz | 141/83 |
| 3,942,561 | 3/1976 | Stoeffler | 141/67 |
| 3,963,467 | 6/1976 | Rolschau | 55/302 X |
| 3,973,935 | 8/1976 | Moore, Jr. et al. | 55/302 |
| 4,083,607 | 4/1978 | Mott | 141/67 X |
| 4,191,223 | 3/1980 | Bourgeois | 141/18 |
| 4,227,900 | 10/1980 | Nichols et al. | 55/302 X |
| 4,312,388 | 1/1982 | Hagar et al. | 141/1 |
| 4,372,713 | 2/1983 | Kean, Jr. | 406/172 |

FOREIGN PATENT DOCUMENTS

| | | |
|---|---|---|
| 7312224 | 7/1973 | Fed. Rep. of Germany . |
| 7309780 | 9/1973 | Fed. Rep. of Germany . |
| 2237740 | 2/1974 | Fed. Rep. of Germany . |
| 2609135 | 9/1977 | Fed. Rep. of Germany . |

OTHER PUBLICATIONS

Brochure, Vulkan-Werk, Fire Extinguishing Filling Devices.

*Primary Examiner*—Stephen Marcus
*Assistant Examiner*—Ernest G. Cusick
*Attorney, Agent, or Firm*—Steele, Gould & Fried

[57] ABSTRACT

The invention relates to a checking and filling device for powder extinguishers, which is provided with a reversing device, a suction fan and a separator. Its separator has a filter for retaining the extinguishing powder sucked from a powder extinguisher. The suction side and the pressure side of the suction fan can be alternately connected with the outlet side of the filter and the air flow direction can be reversed by operating the reversing device. Apart from the aforementioned filter, a reversing filter independent thereof is associated with the separator and enables the reversed air to be filtered.

14 Claims, 7 Drawing Figures

CHECKING AND FILLING DEVICE FOR POWDER EXTINGUISHERS

BACKGROUND OF THE INVENTION

1. Field of the Invention

The present invention relates to a checking and filling device for powder extinguishers with a reversing device, a suction fan and a separator, which has a filter for retaining the extinguishing powder sucked out of a powder extinguisher, and in particular one in which both the suction side and the pressure side of the suction fan can be alternately connected to the outlet side of the filter and the air flow direction can be reversed by operating the reversing device.

2. Prior Art

When checking a powder extinguisher or its content, the extinguishing powder contained in the powder extinguisher is generally transferred into an intermediate container, e.g. an empty powder extinguisher, from which it is returned with the aid of a device which is equipped with a suction mechanism, e.g. a suction fan and a separator, which is constructed in funnel-shaped manner in its lower area. A filter is associated with the suction mechanism of this fan and prevents the extinguishing powder sucked out of the intermediate container from getting into the suction mechanism and impairing its operation. On the side of the filter remote from the suction mechanism, extinguishing powder is very rapidly deposited and these deposits reduce the suction force of the suction mechanism. Therefore devices have already been developed which are equipped with vibrators or shakers enabling the aforementioned extinguishing powder deposits to be removed. However, it is considered a disadvantage of these devices that filter cleaning can only commence when the associated suction mechanism is switched off and has come to a stop. The latter is unnecessary in the case of a device according to German Patent Application No. P 33 15 893.2, the priority of which is claimed in which the suction mechanism constructed as a suction fan is arranged on the separator and is tightly connected thereto by means of an adaptor, the latter having a control element enabling the air flow sucked in by the suction mechanism to be switched to powder suction or separator blow-through, as required. There is no need to switch off the suction mechanism in this device during the cleaning process. In fact, the suction mechanism can continue to run and can be used for cleaning purposes until a pressure cushion has built up within the separator, which prevents further filter reverse scavenging.

SUMMARY OF THE INVENTION

The object of the invention is to improve a checking and filling device of the afore-mentioned type with respect to the possibility of cleaning its separator - filter.

According to the invention this object is achieved in that a reversing filter, independent of the first filter, is associated with the separator and through which the reversed air can be filtered, i.e. a filter which filters the reversed air prior to its exit from the separator. Such a filter prevents a pressure cushion that would otherwise stop the cleaning of the first filter from building up in the separator and consequently ensures that the first filter can be "flushed-back" until all the extinguishing powder deposits have been removed therefrom.

The reversing device of the checking and filling device according to the invention is preferably manually operable, which offers the advantage that no separate drive is required and that the reversing process can be adapted to the given circumstances.

In the checking and filling device according to the invention, the filling device can be placed on its separator and can in particular be constructed as a control slide valve positioned between its suction fan and the separator. A device constructed in such a way can be transported without difficulty to the place of use due to its compact construction, where it can also be operated without difficulty.

If the reversing device is a control slide valve arranged between the suction fan and the separator, said valve can have a discharge duct preferably equipped with a check valve passing into the atmosphere from the reversing filter and the reversed air can pass into the atmosphere through said duct.

The control slide valve is preferably a rotary slide valve, which offers the advantage that it can be easily operated without impeding the user of the device. In the checking and filling device according to the invention, the reversing device can also be positioned separately from the separator and can be connected thereto by means of air lines. If this is the case, the reversing device preferably has a mechanical control element, which projects into the vicinity of the separator, which offers the advantage that it can be operated by the user at any time, even during the filling process. A flexible shaft can be associated with this mechanical control element.

In the case of the checking and filling device according to the invention, the reversing filter is preferably arranged in the separator, so that extinguishing powder adhering thereto can drop back into the separator at the end of the reversing process. In order to facilitate the latter, the filter area of the reversing filter preferably points downwards.

The reversing filter in the checking and filling device according to the invention can be constructed as a ring-type filter and is optionally preferably arranged between the two walls of a double-walled separator, so that the reversed air can escape uniformly upwards out of the separator.

To ensure that the reversed air does not leave the separator by the shortest route, an air circulation or guidance means can be provided, which guides the reversed air to the reversing filter below the separator - filter.

In the checking and filling device according to the invention, one or more filter cartridges can constitute the reversing filter and this offers the advantage that they can be easily replaced. The filter cartridges can be surrounded from a casing which is open at the bottom, which extends at least down to the lower end of the filter or the separator filter and ensures that the reversed air is guided to the reversing filter below the separator - filter.

The reversing filter can advantageously be a sintered filter, because the checking and filling device according to the invention does not use a vibrator or shaker.

An air circuit can be connected into the reversing filter, which leads from the blowing side of the device backwards through the separator, through the reversing filter and back to the suction side of the device, so that the environment is in no way prejudiced by the reversing process. If such an air circuit is connected into the reversing filter, the line running from the reversing filter to the reversing device can be closed on changing to normal operation, which ensures that no infiltrated air can flow into the separator under normal operating conditions.

In the checking and filling device according to the invention, the reversing filter can be cleaned by air reversal, particularly by a delayed pressure drop on the clean side of the reversing filter. For such a delayed pressure drop on the clean side of the reversing filter, it is optionally possible to use the check valve associated with the reversing filter on switching over to normal operation due to delayed valve closure and/or an empty volume present on the clean side of the reversing filter.

A check valve can be associated with the reversing filter and is positioned on the clean side of the reversing filter directed away from the filter area, which leads to the advantage that easy access and replacement of the reversing filter are possible.

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
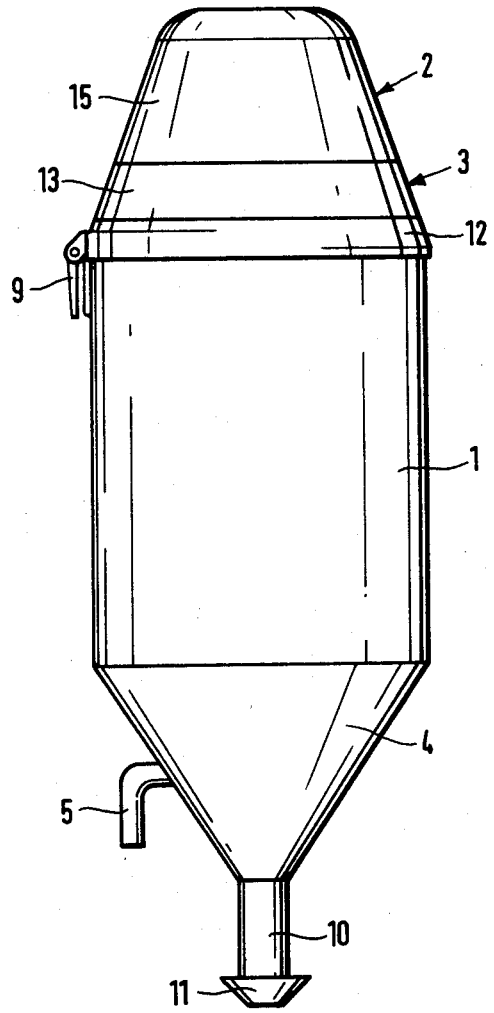
FIG. 1 is a side view of a checking and filling device according to the invention.

The device shown in FIG. 1 essentially comprises a separator 1, a suction attachment 2 and an adaptor 3 arranged between separator 1 and suction attachment 2 and which are in each case tightly interconnected.

Separator 1 is shaped like a circular cylinder and to its downwardly projecting end remote from adaptor 3 is attached a frustum-shaped extension 4 on which is provided a connection piece 5 for a tubular feed line. Separator 1 contains filter element 6, particularly in the form of plastic sintered filter cartridges, which are fixed to a filter plate 7. The latter is carried by packing ring 8, which also has the function of ensuring a tight connection between separator 1 and adaptor 3, when both of these are flapped together and are closed by the associated gripping closure 9.

The frustum-shaped extension 4 of separator 1 passes into a sleeve 10, which is provided at its free end with a frustum-shaped mouthpiece 11.

Adaptor 3 comprises two parts 12, 13, which can be turned concentrically with respect to one another and whereof one is fixed and serves as a support 12 for a suction fan 14 arranged in suction attachment 2. Part 13 of adaptor 3 concentrically turnable with respect to support 12 is constructed as a control slide valve enabling, as required, the air flow sucked in by the suction fan 14 to be switched either to powder suction, or to separator blow-through.

Apart from suction fan 14, support 12 carries a covering hood 15 which passes over the latter and which forms part of the air guidance channel for the air flow sucked in by suction fan 14. Support 12 is peripherally provided with a plurality of channel-like openings 16, 19, which are linked with the suction fan 14.

The control slide valve 13 peripherally carries several deflecting devices 17, 18 and two radially oriented, superimposed openings 20, 21, which can be made to coincide with the openings 16, 19 in support 12 by turning the control slide valve. The aforementioned deflecting devices of control slide valve 13 are formed by chambers 17, 18 open towards support 12 and which are formed in control slide valve 13, while either being open towards separator 1 or towards the outside.

Figure 2:
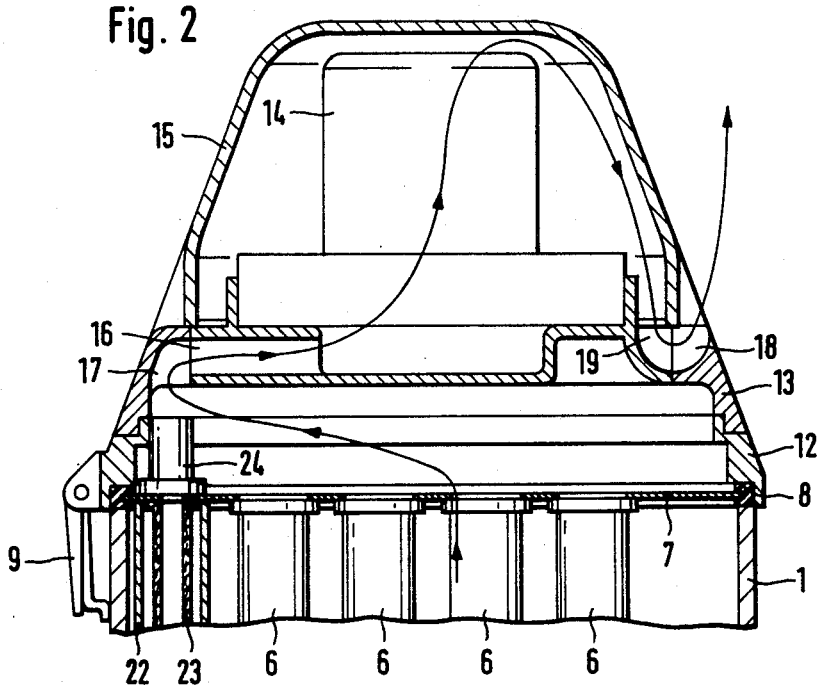
FIG. 2 is a sectional partial side view of the checking and filling device of FIG. 1, whose control element is switched to powder suction.

If control slide valve 13 assumes the position shown in FIG. 2, then after switching on the suction fan 14 extinguishing powder is sucked in by a not shown suction line connected to connecting piece 5, as soon as the free end of this suction line has been introduced into an extinguishing powder storage means or a fire extinguisher filled with such powder. The sucked in extinguishing powder passes into the separator 1 and accumulates in the receptacle area defined by extension 4 and after opening a closure flap provided in sleeve 10 flows downwards under gravity into a fire extinguisher which is to be filled.

On sucking extinguishing powder into the interior of separator 1, a certain amount of extinguishing powder is always deposited on the filter, i.e. on the bottom of filter plate 7 and externally on filter element 6. This can be detached again and can also be transferred into a fire extinguisher to be filled, in that the control slide valve 13 is turned into one of the positions shown in FIGS. 3 and 4.

Figure 3:
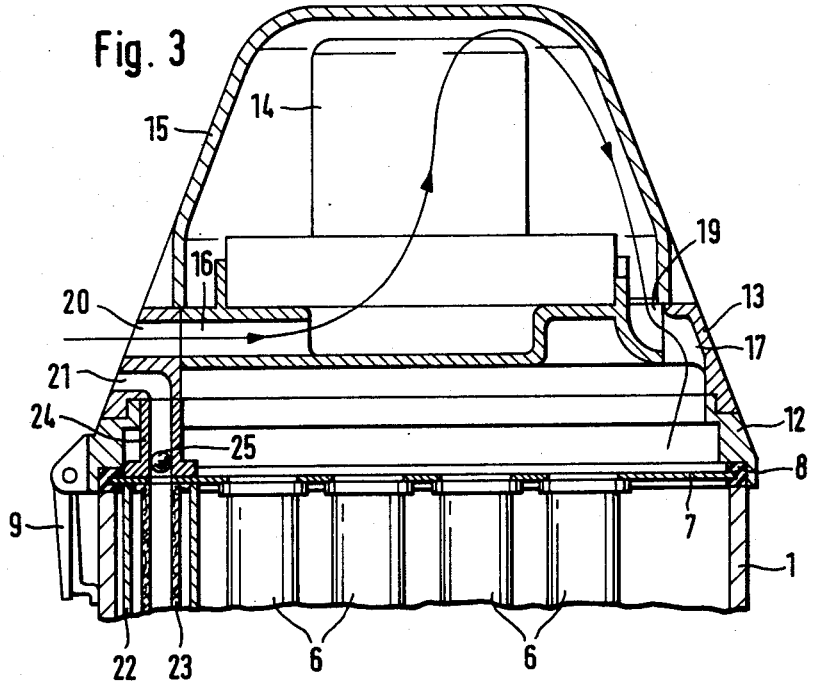
FIG. 3 is a sectional partial side view of the checking and filling device of FIG. 1, whose control element is switched to separator blow-through using fresh air.

In the position of the control slide valve 13 shown in FIG. 3, suction fan 14 sucks in air from the outside via the linked openings 20 and 16. The air initially passes into the interior of covering hood 15 and from there via a deflecting device 19 of support 12 communicating with a chamber 17 of valve 13 into the space above filter plate 7, after which it flows through the latter and the filter elements 6 held by it, whilst detaching extinguishing powder adhering thereto. The detached extinguishing powder drops downwards into the separator extension 4 and can subsequently be transferred therefrom into a fire extinguisher to be filled.

To the bottom of filter plate 7 is fixed a sleeve 22, shown to the left in the drawing, whose length somewhat exceeds that of the individual filter element 6. A cartridge-like reversing filter 23 is placed in sleeve 22. To the top of filter plate 7 is fixed a cylindrical cap 24 which is aligned with the sleeve 22 and in whose interior is arranged a ball valve with a valve ball 25.

The air flowing into the separator, after passing through filter plate 7 and filter element 6, flows downwards into the sleeve 22, flows through the reversing filter 23 arranged therein, raises the valve ball 25, flows through cap 24 and from there passes into the atmosphere via a radially directed opening 21 of control slide valve 13 which is linked therewith.

The superimposed, radially oriented openings 20, 21 of control slide valve 13 consequently form the start and finish of an air flow passing through the complete device, opening 20 forming an inlet and opening 21 an outlet.

Figure 4:
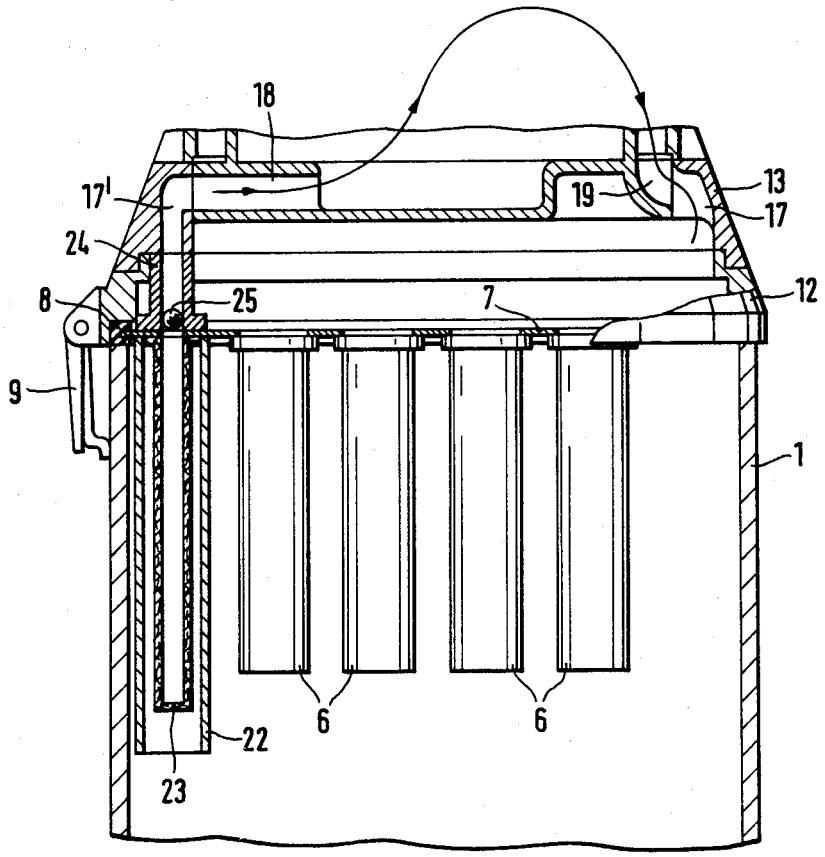
FIG. 4 is a sectional partial side view of the checking and filling device of FIG. 1, whose control element has been switched to separator blow-through without fresh air.

In the position of the control slide valve 13 shown in FIG. 4, working takes place without fresh air, i.e. with the air located in the device. The air sucked in by the suction fan is supplied to separator 1 in accordance with the control slide valve position shown in FIG. 3 and from there passes via sleeve 22, reversing filter 23 and the cap 24 positioned above it into a chamber 17' of control slide valve 13, from where it is sucked in by the suction fan via an opening 16 linked with the latter.

Figure 5:
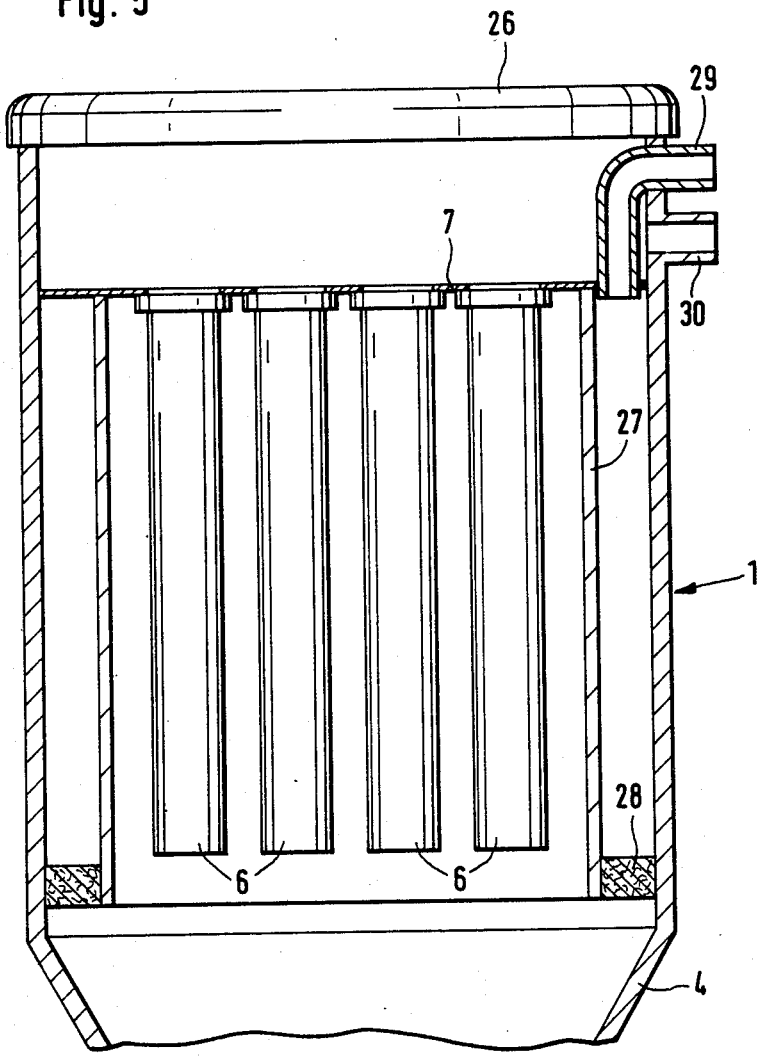
FIG. 5 is a part sectional partial side view of another embodiment of a checking and filling device according to the invention.
Figure 6:
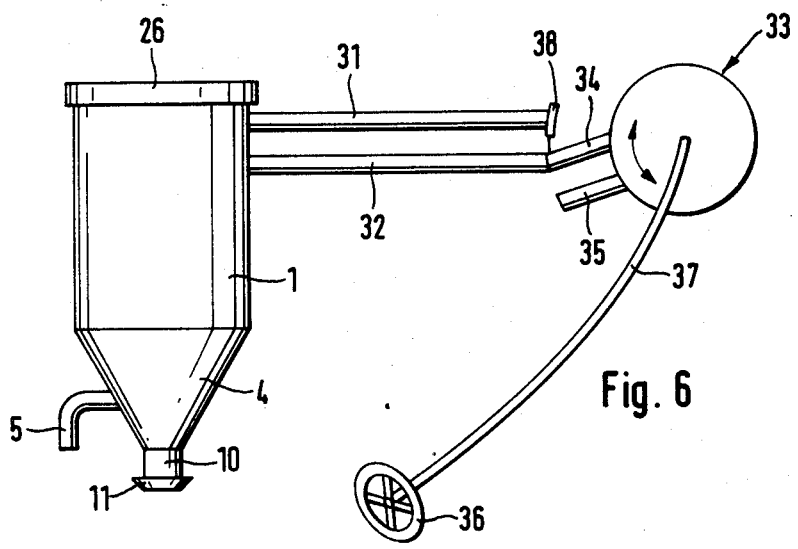
FIG. 6 is the checking and filling device of FIG. 5 with the reversing devices associated therewith in normal operation.
Figure 7:
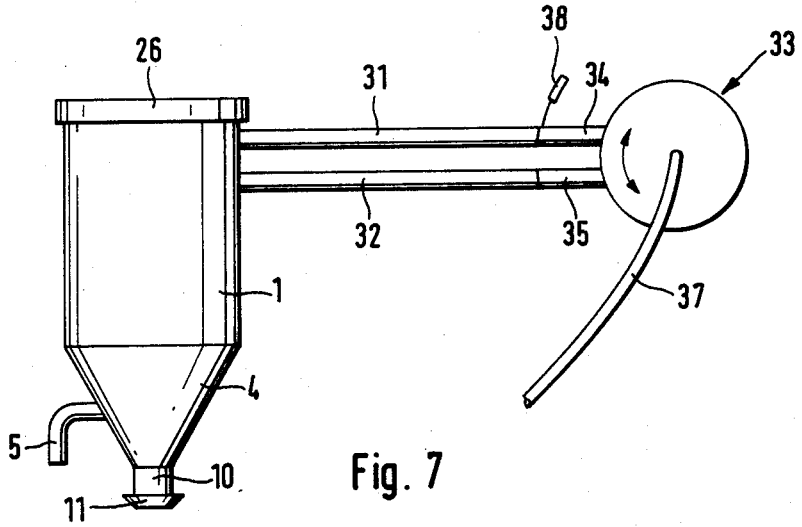
FIG. 7 is the checking and filling device shown in FIG. 5 with the reversing device associated therewith in reversing operation.

The device shown in FIGS. 5 to 7 essentially comprises a separator 1, which is equipped with a hood or dome-like cover 26. In accordance with the originally described embodiment, separator 1 is shaped like a circular cylinder, to whose lower end is connected a frustum-shaped extension 4, on which is provided a connecting piece 5 for a tubular feed line. Separator 1 also contains filter elements, which are fixed to a filter plate 7. The frustum-shaped extension 4 of separator 1 also passes in this embodiment into a sleeve 10, which is provided at its free end with a frustum-shaped mouthpiece 11.

In the case of the device shown in FIGS. 5 to 7, the circular cylindrical separator 1 has a double-walled construction in its circular cylindrical area, i.e. it has there an additional inner jacket 27, which is arranged concentrically to the outer jacket. In the lower area of the annular gap formed between the inner and outer jackets is provided an annular reversing filter 28.

In the upper area of the device shown in FIGS. 5 to 7 are provided two superimposed connecting pieces 29, 30, whereof the upper connecting piece 29 is linked with the annulus between the inner and outer jackets of separator 1 and the lower connecting piece 30 is linked with the space above filter plate 7. Lines 31, 32 are connected into the two connecting pieces 29, 30 and lead to a reversing device 33.

The reversing device has a suction fan with two connecting pieces 34, 35 and can be pivoted by means of a flexible shaft coupled to a regulating wheel 36 in such a way that its connecting piece 34, shown at the top in the drawing, can be linked with the free end of one of the two lines 31, 32 fixed to the connecting pieces 29, 30 of separator 1. Reversing device 33 also has a closure member 38 rigidly connected with connecting piece 34 and it closes the upper line 31, when connecting piece 34 is linked with the lower line 32.

When reversing device 33 assumes the position shown in FIG. 6, following the switching on of its suction fan by means of the connecting piece 34 and line 32 connected therewith, air is sucked out of the separator zone located above filter plate 7, so that by means of a not shown suction line connected to connecting piece 5, extinguishing powder is sucked in as soon as the free end of this suction line is introduced into an extinguishing powder storage means or into a fire extinguisher filled with said powder. The sucked-in extinguishing powder passes into separator 1 and its extension 4 and, after opening a closure flap provided in sleeve 10, can flow downwards under the action of gravity into a fire extinguisher to be filled.

On sucking the extinguishing powder into the interior of separator 1, some extinguishing powder is deposited on the separator filter, i.e on the bottom of filter plate 7 and externally on the filter element 6, in the case of the embodiment of FIGS. 5 to 7. This can be detached and transferred into the fire extinguisher to be filled, by pivoting the reversing device into the position shown in FIG. 7. In this position, the suction fan of the reversing device 33 sucks air via connecting piece 35 and line 32 out of the annulus between the inner and outer jackets of separator 1 and forces this via connecting piece 34 and line 31 into the separator area above filter plate 7 and flows through the latter and the filter element 6 fixed thereto, so that extinguishing powder adhering thereto is detached and drops downwards into the conical extension 4 of separator 1, where it can be transferred into a fire extinguisher to be filled.

Flexible shaft 37 is dimensioned in such a way that the associated regulating wheel 36 can be operated without difficulty by the person carrying out the filling process.

In the embodiment of FIGS. 5 to 7, filter plate 7 has an air-impermeable edge area shown in FIG. 5 and this terminates the annular clearance between the inner and outer walls of separator 1.

What is claimed is:

1. A checking and filling device for powder extinguishers, comprising:

a suction fan having a suction side and a pressure side;

a separator having a filter with an inlet side for accumulating powder and an outlet side, the separator also having a receptacle area for retaining extinguishing powder;

a reversing device comprising a rotary slide valve having movable selectable connections for the separator and the suction side and the pressure side of the suction fan, the reversing device being operable to alternately connect the suction fan to the outlet side of the filter whereby a direction of continuous air flow is reversed by operating the reversing device; and, a reversing filter independent of the first filter, disposed between the suction fan and the separator, the reversing filter removing powder from the reversed air, whereby air is blown backwards through the reversing filter in the reversing operation for cleaning said reversing filter by a delayed pressure drop.

2. A device according to claim 1, wherein the reversing device is manually operable.

3. A device according to claim 1, in which the reversing device is manually operable and is mounted on the separator, the reversing device having a control slide valve arranged between the suction fan and the separator.

4. A checking and filling device for powder extinguishers, comprising:

a suction fan having a suction side and a pressure side;

a separator having a filter with an inlet side for accumulating powder and an outlet side, the separator also having a receptacle area for retaining extinguishing powder;

a reversing device having movable selectable connections for the separator and the suction side and the pressure side of the suction fan, the reversing device being operable to alternately connect the suction fan to the outlet side of the filter whereby a direction of air flow is reversed by operating the reversing device;

said reversing device being manually operable and on the separator, the reversing device having a control slide valve arranged between the suction fan and the separator;

a reversing filter independent of the first filter, operatively disposed upon operation of the reversing device between the suction fan and the separator, the reversing filter removing powder from the reversed air; and said control slide valve having a discharge duct leading from the reversing filter to outside air.

5. A device according to claim 4, wherein the reversing filter is arranged in the separator.

6. A device according to claim 4, wherein the filter area of the reversing filter is directed toward the receptacle area.

7. A device according to claim 4, further comprising at least one air guidance device, which guides air from below the first filter to the reversing filter.

8. A device according to claim 4, wherein the reversing filter includes a filter cartridge.

9. A device according to claim 8, wherein the receptacle area is below the first filter and the filter cartridge is surrounded by a casing which is open at its bottom and which extends at least down to a lower end of the first filter.

10. A device according to claim 4, wherein the movable selectable connections of the reversing device define an air circuit that can be connected to the reversing filter leading from the pressure side of the suction fan backwards through the separator, the reversing filter and back to the suction side of the suction fan.

11. A device according to claim 4, wherein the reversing filter can be cleaned upon operation of the reversing device by air reversal causing a delayed pressure drop on a clean side of the reversing filter.

12. A device according to claim 4, wherein a check valve is associated with the reversing filter and is arranged on a clean side of the reversing filter at a space from a filter area of the reversing filter.

13. A checking and filling device for powder extinguishers, comprising:

a suction fan having a suction side and a pressure side;

a separator having a filter with an inlet side for accumulating powder and an outlet side, the separator also having a receptacle area for retaining extinguishing powder;

a reversing device having movable selectable connections for the separator and the suction side and the pressure side of the suction fan, the reversing device being operable to alternately connect the suction fan to the outlet side of the filter whereby a direction of air flow is reversed by operating the reversing device;

said reversing device being manually operable and mounted on the separator, the reversing device having a rotary slide valve arranged between the suction fan and the separator;

a reversing filter independent of the first filter, operatively disposed upon operation of the reversing device between the suction fan and the separator, the reversing filter removing powder from the reversed air.

14. A checking and filling device for powder extinguishers, comprising:

a suction fan having a suction side and a pressure side;

a separator having a filter with an inlet side for accumulating powder and an outlet side, the separator also having a receptacle area for retaining extinguishing powder;

a reversing device having movable selectable connections for the separator and the suction side and the pressure side of the suction fan, the reversing device being operable to alternately connect the suction fan to the outlet side of the filter whereby a direction of air flow is reversed by operating the reversing device;

said reversing device being manually operable and mounted on the separator, the reversing device having a rotary slide valve arranged between the suction fan and the separator;

a reversing filter independent of the first filter, operatively disposed upon operation of the reversing device between the suction fan and the separator, the reversing filter removing powder from the reversed air;

said control slide valve having a discharge duct leading from the reversing filter to outside air; and a check valve in the separator operable to close in a delayed manner during at least one on switching of the reversing device to normal operation and occurrence of an empty volume on a clean side of the reversing filter, delayed closing of the check valve bringing about a delayed pressure drop.

* * * * *